US006908347B2

(12) United States Patent
Sasaki

(10) Patent No.: US 6,908,347 B2
(45) Date of Patent: Jun. 21, 2005

(54) COMPRESSION TYPE CONNECTOR AND THE CONNECTING STRUCTURE THEREOF

(75) Inventor: Yuichiro Sasaki, Matsumoto (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 0 days.

(21) Appl. No.: 10/381,078

(22) PCT Filed: Oct. 3, 2001

(86) PCT No.: PCT/JP01/08708

§ 371 (c)(1),
(2), (4) Date: Mar. 18, 2003

(87) PCT Pub. No.: WO02/35656

PCT Pub. Date: May 2, 2002

(65) Prior Publication Data

US 2003/0190825 A1 Oct. 9, 2003

(30) Foreign Application Priority Data

| | | |
|---|---|---|
| Oct. 26, 2000 | (JP) | 2000-326524 |
| Nov. 1, 2000 | (JP) | 2000-334658 |
| Nov. 21, 2000 | (JP) | 2000-354803 |
| Nov. 21, 2000 | (JP) | 2000-354805 |

(51) Int. Cl.[7] ..... H01R 13/24
(52) U.S. Cl. ..... 439/824; 439/66; 439/700
(58) Field of Search ..... 439/700, 66, 824

(56) References Cited

U.S. PATENT DOCUMENTS

| | | | | |
|---|---|---|---|---|
| 3,378,810 A | * | 4/1968 | Dorrell | 439/436 |
| 5,127,837 A | * | 7/1992 | Shah et al. | 439/71 |
| 5,151,040 A | * | 9/1992 | Tanaka | 439/73 |
| 5,518,410 A | * | 5/1996 | Masami | 439/71 |
| 5,641,315 A | * | 6/1997 | Swart et al. | 439/824 |
| 5,727,954 A | * | 3/1998 | Kato et al. | 439/66 |
| 6,159,056 A | | 12/2000 | Boyle | 439/700 |
| 6,447,343 B1 | * | 9/2002 | Zhang et al. | 439/700 |
| 6,464,511 B1 | * | 10/2002 | Watanabe et al. | 439/66 |
| 6,769,919 B2 | * | 8/2004 | Kosmala | 439/66 |

FOREIGN PATENT DOCUMENTS

| | | |
|---|---|---|
| JP | 6-168756 A | 6/1994 |
| JP | 07/161401 | 6/1995 |
| JP | 10-189111 A | 7/1998 |
| WO | WO 00/31828 | 6/2000 |

* cited by examiner

*Primary Examiner*—Gary Paumen
(74) *Attorney, Agent, or Firm*—Darby & Darby

(57) ABSTRACT

A compression type connector is constructed of a cap-like conductive toe-pin 1, a conductive pin 10 fitted and slidably supported within conductive toe-pin 1 and a coil spring 20 fitted on conductive pin 10 and repulsively urging the conductive pin 10 upwards or in the direction opposite to the bottom of conductive toe-pin 1. A multiple number of the compression type connectors are arranged in an insulative housing 50 interposed between electrodes 31 and 41 of an electronic circuit board 30 and an electrically joined object 40, each opposing the other. Each conductive toe-pin 1 is put into contact with electrode 31 of electronic circuit board 30 and conductive pin 10 into contact with electrode 41 of electrically joined object 40, to establish electrical connection between electronic circuit board 30 and electrically joined object 40. Since conductive pin 10 and coil spring 20 are united and fitted into conductive toe-pin 1 so that conductive toe-pin 10 can reciprocate therein, it is possible to reduce the height of the compression type connector and realize a low-resistance and low-load connection.

3 Claims, 18 Drawing Sheets

COMPRESSION TYPE CONNECTOR AND THE CONNECTING STRUCTURE THEREOF

TECHNICAL FIELD

The present invention relates to a compression type connector and its connecting structure for use in electrical connection between an electronic circuit board and liquid crystal module, connection between multiple electronic circuit boards, connection between a certain type of IC package and an electronic circuit board and connection of an electronic circuit board with a microphone, speaker or the like of a cellular phone or a portable information terminal.

BACKGROUND ART

Conventionally, there are various techniques to make electric connection of an electronic circuit board of a cellular phone with a liquid crystal module or with an electroacoustic part. Though not illustrated, as the connecting method, any of the following techniques can be used: (1) a method of using a compression type connector with a multiple number of metallic fine wires arranged in a row on the curved surface of an elastomer piece having an approximately semielliptical section or approximately U-shaped section; (2) a method of using the connector pins for electrical connection disclosed in Japanese Patent Application Laid-open Hei 7-161401; and (3) a method of creating connection by soldering conductive wires between the electrodes of an electronic circuit board and an electroacoustic part.

Conventional electrical connections are made as described above, and any of the above connecting methods can provide the connection function within limits.

With the recent development of cellular phones and the like, into thin, light-weight and compact configurations, there has been a demand for the height of compression type connectors and connector pins for electrical connection to be reduced. However, it is no more possible for the above conventional techniques to create a connection having a shorter height (about 5 mm at present), hence it is impossible to shorten the route of conduction. It is also considerably difficult to create a low-load connection. Further, since the above connectors are provided between the electronic circuit board and liquid crystal module with their holder omitted, it is impossible to mount them on the electronic circuit board itself, and there occur not a few cases in which positioning accuracy and assembly performance degrade. Moreover, connection by soldering wires inevitably needs work progress management, and there is a trend away from the use of button solder, considering the environment.

DISCLOSURE OF INVENTION

The present invention has been devised in view of the above circumstances, it is therefore an object of the present invention to provide a compression type connector which is low in height and hence can reduce the route of conduction and enables low-load connections. It is another object to provide a connecting structure of a compression type connector which can be improved in positioning accuracy and assembly performance. It is a further object to provide a connecting structure of a compression type connector which can make the work simple by omitting soldering.

In order to attain the above object, the invention defined in Claim 1 comprises: a conductive toe-pin having a cap-like shape; a conductive pin fitted into the conductive toe-pin in a slidable manner; and a spring fitted on conductive pin, and is characterized in that the spring rests on the opening end face of the conductive toe-pin so as to urge the conductive pin in the direction opposite the bottom of the conductive-toe pin.

Secondary, in order to attain the above object, for achieving connection between electronic circuit boards, for example, the invention defined in Claim 2 is characterized in that an insulative housing to be interposed between opposing electrodes has a multiple number of passage holes formed therein, and a compression type connector defined in Claim 1 is fitted in each passage hole in such a manner that the bottom of the conductive toe-pin of the compression type connector is projected from one side of the housing and the conductive pin of the compression type connector is projected on the other side of the housing.

Further, in order to attain the above object, for achieving connection of a microphone, speaker or the like for a cellular phone or portable information terminal, the invention defined in Claim 3 is characterized in that an insulative holder to be interposed between opposing electrodes is formed in an approximate cylinder with a bottom and has a multiple number of passage holes formed in the bottom, and a compression type connector defined in Claim 1 is fitted in each passage hole in such a manner that the bottom of the conductive toe-pin of the compression type connector is projected from one side of the holder's bottom and the conductive pin of the compression type connector is projected on the other side of the holder's bottom, toward the open side.

Here, the end faces of the conductive toe-pin and conductive pin defined in the Claims may be formed, as appropriate, in a pointed form of a predetermined angle, a form having a semicircular section, semi-elliptic section or semi-oval section, a form having a single or multiple pins, a crown shape, a tooth-like pin-joint dowel form (dowel: architecture technical term), dowel rivet form (dowel: architecture technical term) and the like. In particular, if the end part of the conductive toe-pin or conductive pin is formed with a pointed form such as a conical or pyramidal form, the oxide film over the solder of the electrode can be broken so as to establish a good conduction. The housing may be rectangular, square, polygonal, elliptic or oval or of other shapes. Examples of the electrically joined object having electrodes include assorted types of circuit boards, test circuit boards, liquid crystal modules (COG, COF, TAB and the like), assorted types of IC packages such as surface mount types (QFP, BGA, LGA, etc.), various electronic parts such as microphones, speakers and others of a cellular phone or electronic device. Further, in most cases, a multiple number of the compression type connectors defined in Claim 1 are embedded in an insulative housing or holder, either directly or indirectly, but this should not be limit the invention: a single connector may be arranged alone.

BEST MODE FOR CARRYING OUT THE INVENTION

Figure 1:
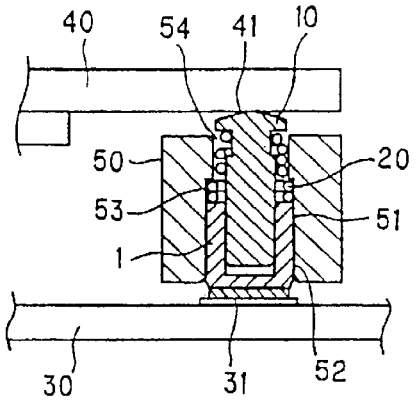
FIG. 1 is a sectional illustrative view showing a state where a compression type connector and its connecting structure according to the present invention are being used in the embodiment.
Figure 2:
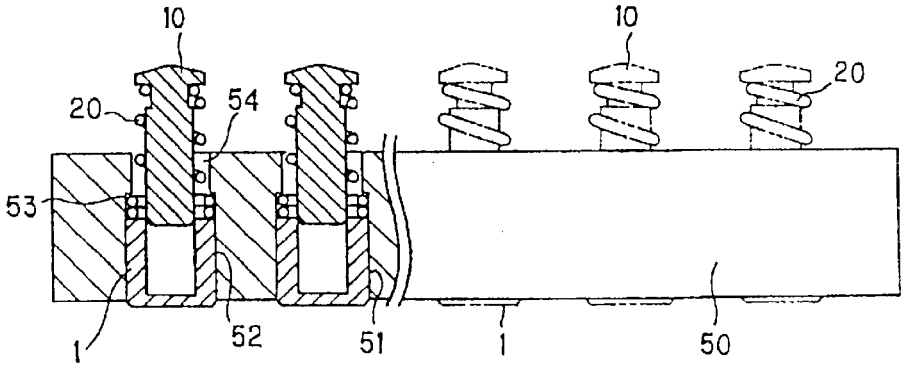
FIG. 2 is a sectional illustrative view showing the embodiment of compression type connectors and their connecting structure according to the present invention.
Figure 3:
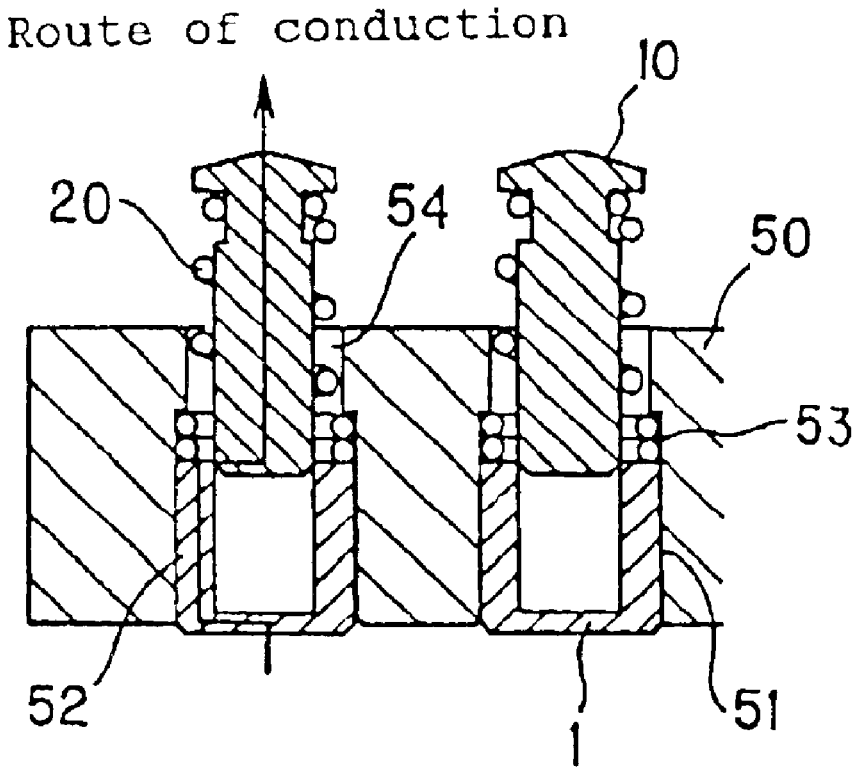
FIG. 3 is a sectional view for explaining the conducting effect in the embodiment of compression type connectors and their connecting structure according to the present invention.

The preferred embodiment of the present invention will be described with reference to the drawings. A miniature compression type connector in the present embodiment includes: as shown in FIGS. 1 through 3, a cap-like conductive toe-pin 1, a conductive pin 10 fitted and slidably supported within conductive toe-pin 1 and a coil spring 20 fitted on conductive pin 10 and repulsively urging the conductive pin 10 upwards or in the opposite direction to the bottom of conductive toe-pin 1. A multiple number of the compression type connectors are arranged in an insulative housing 50 interposed between electrodes 31 and 41 of an electronic circuit board 30 and an electrically joined object 40, each opposing the other, so as to provide electrical conduction between electronic circuit board 30 and electrically joined object 40.

As shown in the same figures, conductive toe-pin 1 is formed of, for example, a cylinder with a bottom having an approximately U-shaped section, with gold-plated conductive material, specifically, copper, brass or aluminum. When conductive toe-pin 1 is arranged in housing 50, the conductive toe-pin 1 may be put into contact, at its flat bottom which is marginally projected from the undersurface (bottom side) as one side of housing 50, with electrode 31 of electronic circuit board 30, or may be appropriately fixed to electrode 31 of electronic circuit board 30 with a solder layer, ACF (anisotropic conductive film) or the like, so as to secure conduction. The projected amount of the bottom of conductive toe-pin 1 is about 0.1 to 1.5 mm, preferably 0.1 to 1.0 mm.

As shown in FIGS. 1 and 2, conductive pin 10 may be, for example, formed of conductive elastomer or conductive copper, brass or aluminum plated with gold and shaped in a cylindrical form. This conductive pin 10 is formed so that an upper part is made smaller in diameter and the head is formed of a large diametric conical or semispherical form, so that the end face of the head comes into acute or smooth contact with electrode 41 of electrically joined object 40.

Coil spring 20 is formed in an approximately frustoconical shape, by winding a predetermined metallic fine wire having a diameter of, for example, 30 to 100 μm or preferably 30 to 80 μm, with a pitch of 50 μm, for example, and placed on the upper end face of the opening of conductive toe-pin 1, so as to produce a load of 30 g to 60 g when compressed by 0.5 mm. As examples of metallic fine wire for forming this coil spring 20, metal wires of phosphor bronze, copper, stainless steel, beryllium bronze, piano wire or other fine metallic wire, or these same wires being plated with gold. The reason for the diameter of the metallic fine wire being limited within the range of 30 to 80 μm is that selection of a value from this range makes it easy to realize a low-cost and low-load connection. The length of coil spring 20 should be, for example, 0.5 to 3.0 mm, preferably 1.0 to 1.5 mm. It is preferred that about half of its length is exposed above and beyond the upper face (obverse face) as the other side of housing 50. Limiting the length within the above range makes it possible to shut out adverse effect due to noise from the outside and maintain the resilient characteristics. Further, the top part of coil spring 20 is formed smaller in diameter than the bottom part, lower part, middle part and upper part, as shown in the same drawing, and is fitted to the groove of the upper part of conductive pin 10 so as to prevent the pin from dislodging and coming off, in a markedly effective manner. Specifically, taking into account the recent development of electrodes 41 into a short pitch arrangement, the diameter at the top part of coil spring 20 is formed smaller by 0.05 to 0.2 mm than that of the middle portion. This limitation is given because there is a possibility that conductive pin 10 will not smoothly fit into conductive toe-pin 1 if the upper part of coil spring 20 has the same diameter as the upper part of conductive pin 10.

As shown in FIG. 1, electronic circuit board 30 may be a printed circuit board, for example, of which multiple electrodes 31 are laid out flat on its surface, and a solder layer consisting of cream solder, ACF or the like is formed on each electrode 31 when the board is connected for conduction.

As shown in the same figure, electrically joined object 40 may be a COG liquid crystal module, for example, and is arranged closely opposing the surface of electronic circuit board 30, located below. This electrically joined object 40 has multiple electrodes 41 constituted of ITO.

As shown in FIGS. 1 through 3, housing 50 is formed of a thin, flat rectangular, or plate-like, monolayered piece using a predetermined material, with multiple small-diametric passage holes 51 bored in the direction of its thickness and arranged lengthwise in a row at intervals of a predetermined pitch. This elongated housing 50 can be formed of multi-purpose engineering plastic which is excellent in heat resistance, dimensional stability, moldability and the like (for example, ABS resin, polycarbonate, polypropylene, polyethylene, etc.). Among these, ABS resin is the most suitable in view of workability and cost.

The multiple passage holes 51 are formed with a pitch of about 0.5 to 1.27 mm, for example. Each passage hole 51 is comprised of, as shown in FIGS. 2 and 3, a large-height fitting bore 52 located on the electronic circuit board 30 side into which conductive toe-pin 1 snugly fits, a sectioned bore 53 which is formed continuously from the upper part of fitting bore 52, creating a space above the top rim of the opening of conductive toe-pin 1, and a reduced-diameter bore 54 located on the electrically joined object 40 side, above a step formed at the top end of sectioned bore 53, all being continuously formed. Conductive toe-pin 1 is fitted from the underside of fitting bore 52 and fixed therein, with its bottom part marginally exposed downward from the undersurface of housing 50. The united conductive pin 10 and coil spring 20 are fitted into sectioned bore 53 so that the bottom end of coil spring 20 is tightly fitted. This tight fitting provides effective prevention of coil spring 20 falling off.

In the above configuration, the compression type connector is positioned and fixed to electronic circuit board 30. Then the compression type connector is positioned and held between electronic circuit board 30 and electrically joined object 40 so that each electrode 31 of electronic circuit board 30 comes into surface contact with conductive toe-pin 1 while each electrode 41 of electrically joined object 40 comes into contact with repulsive conductive pin 10. In this state, as electrically joined object 40 is lightly pressed against electronic circuit board 30, each coil spring 20 contracts and conductive pin 10 with its top part projected above housing 50 moves down into conductive toe-pin 1, whereby electrical connection between electronic circuit board 30 and electrically joined object 40 can be repulsively achieved via conductive toe-pin 1 and conductive pin 10 (see FIG. 1).

According to the above arrangement, since conductive pin 10 and coil spring 20 are united so that conductive pin 10 is fitted into the hollow of conductive toe-pin 1 in a reciprocating manner, the height of the compression type connector can be made short (about 1.50 mm to 2.00 mm) without any difficulty and it is also possible to realize a low-resistance and low-load connection (e.g., 30 g to 60 g/pin). Further, since conductive toe-pin 1 which is excellent in stability and mountability is fitted and plugged into each passage hole 51 while conductive pin 10 is put into contact with electrode-41 of electrically joined object 40, establishment of stable conduction can be highly expected. Moreover, since, as indicated by the arrow in FIG. 3, conductive toe-pin 1 and conductive pin 10 are put into regular contact with each other by their peripheries to create the shortest route of conduction, it is possible to shorten the route of conduction and hence markedly reduce the inductance and achieve improved high-frequency characteristics, in contrast to the case where conduction path is formed only by a long coil spring which is spirally wound. It is also possible to shorten the length of conductive pin 10. Further, since the compression type connector is held between electronic circuit board 30 and electrically joined object 40, by means of housing 50, it is possible to easily assemble or mount the compression type connector into electronic circuit board 30, hence markedly improve the positioning accuracy and assembly performance. When the head of conductive pin 10 is formed so as to be semispherical or semi-spheroidal, stable conduction can be secured even if, for example, coil spring 20 becomes tilted left and right or back and forth. Further, since the bottom part of coil spring 20 is held by sectioned bore 53 and conducive toe-pin 1, it is possible to prevent coil spring 20 from dislodging by a simple arrangement. Still more, since coil spring 20 is formed of a locally stepped and tapered structure with three different diameters and its attitude can be kept stably, the conductive pin 10 will never be adversely affected from external force in the horizontal direction even if conductive pin 10 is projected from housing 50.

Though the above embodiment is illustrated with a simple type of housing 50, the present invention should not be limited thereto. For example, slits having an approximate triangular section, for example, may be formed by cutting out both sides of housing 50, at a number of sites corresponding to the number of conductive pins 10 so that housing 50 can be divided into pieces of conductive pins 10. Since this arrangement facilitates the user to omit unnecessary conductive pins 10 by simply separating housing 50 into pieces of conductive pins 10 with the help of the slits, assembly performance, mountability and work performance can be markedly improved. Alternatively, while a pair of unillustrated positioning holes may be formed in electronic circuit board 30, a pair of positioning pins, to be mentioned below, may be embedded at both extremes on the underside of housing 50 so as to extend downwards, whereby the compression type connectors can be positioned and fitted to electronic circuit board 30 using these positioning holes and positioning pins. This arrangement makes it possible to further improve the positioning accuracy and mountablity of the compression type connectors by the simple configuration.

(Embodiment)

The embodiment of a compression type connector and its connecting structure according to the invention will be described.

To begin with, a compression type connector was positioned and fixed to an electronic circuit board with cream solder so that the compression type connector was positioned and held between the electronic circuit board and the electrically joined object. Each electrode of the electronic circuit board was brought into surface contact with the conductive toe-pin while each electrode of the electrically joined object was put into contact with the conductive pin.

The conductive toe-pin and conductive pin were formed by plating gold over nickel as a pre-plating over brass. As the fine metallic wire forming the coil spring, a piano wire having a diameter of 70 $\mu$m was used. The housing was made of ABS resin and formed so as to have a height of 1.25 mm with ten passage holes arranged in a row with a pitch of 1.0 mm. In each of the multiple passage holes, a conductive pin and coil spring having a height of 2.0 mm were assembled. In each passage hole, the part from the lower end of the opening of the fitting hole to the sectioned bore was formed to be 0.85 mm in diameter and the reduced-diameter bore was formed to be 0.55 mm in diameter.

Then, the electrically joined object was pressed against the electronic circuit board so as to establish repulsive electric conduction between the electronic circuit board and the electrically joined object, via the conductive toe-pins and conductive pins. The relationship between the amount of contraction of the compression type connector and the applied load is depicted in the graph shown in FIG. 4. In this chart, the ordinate indicates the load per each conductive pin (N/pin) and the abscissa the amount of contraction (mm).

Figure 5:
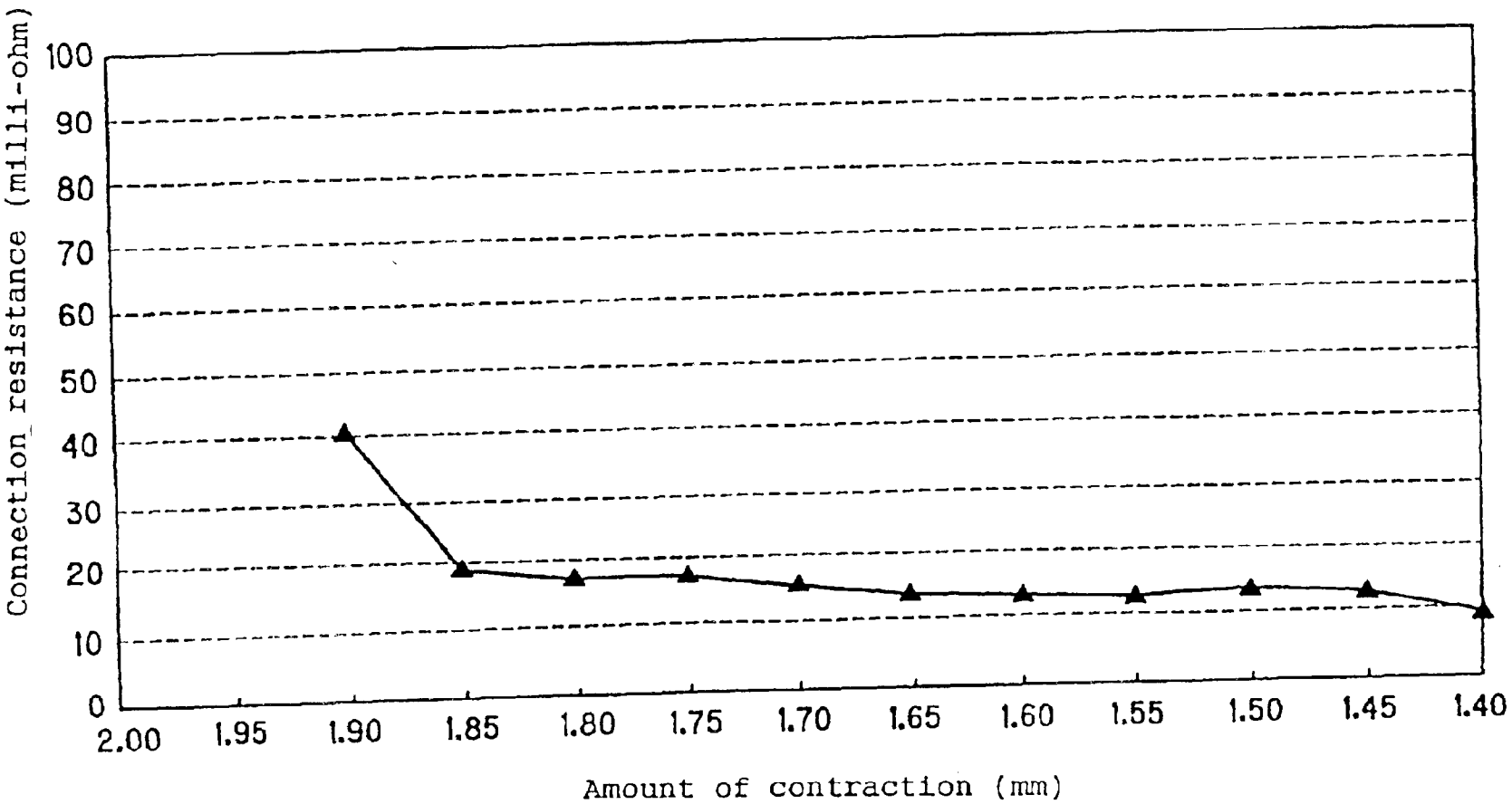
FIG. 5 is a graph showing the relationship between the amount of contraction and the value of resistance in the embodiment of compression type connectors and their connecting structure according to the present invention.
Figure 6:
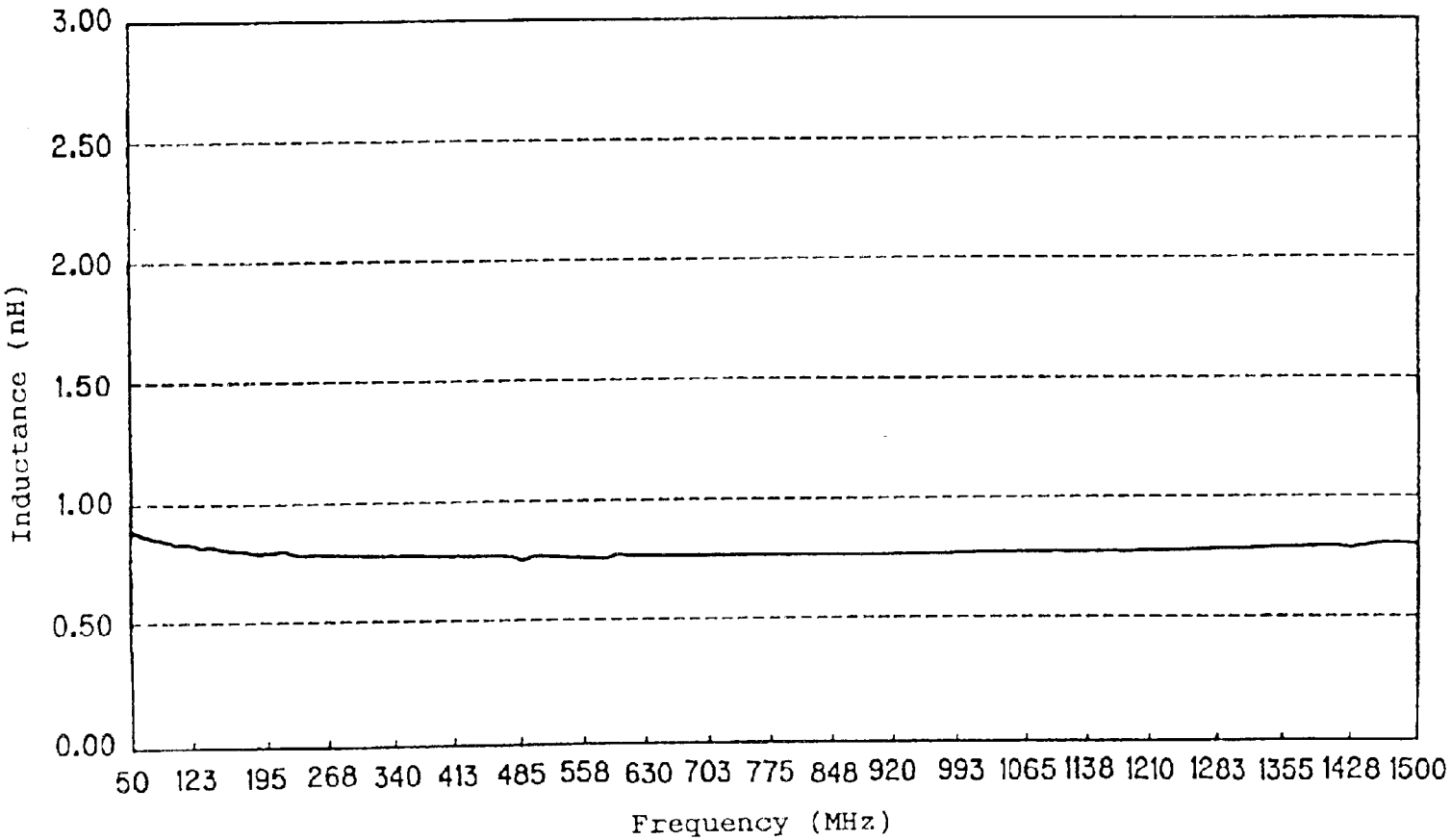
FIG. 6 is a graph showing the relationship between the amount of contraction and the inductance in the embodiment of compression type connectors and their connecting structure according to the present invention.

Further, FIG. 5 shows a graph representing the relationship between the amount of contraction and connection resistance of the compression type connector. FIG. 6 shows a graph representing the relationship between the amount of contraction and inductance of the compression type connector. In FIG. 5, the ordinate indicates the connection resistance (milli-ohm) and the abscissa the amount of contraction (mm). In FIG. 6, the ordinate indicates the inductance (nH) and the abscissa the frequency (MHz).

Figure 4:
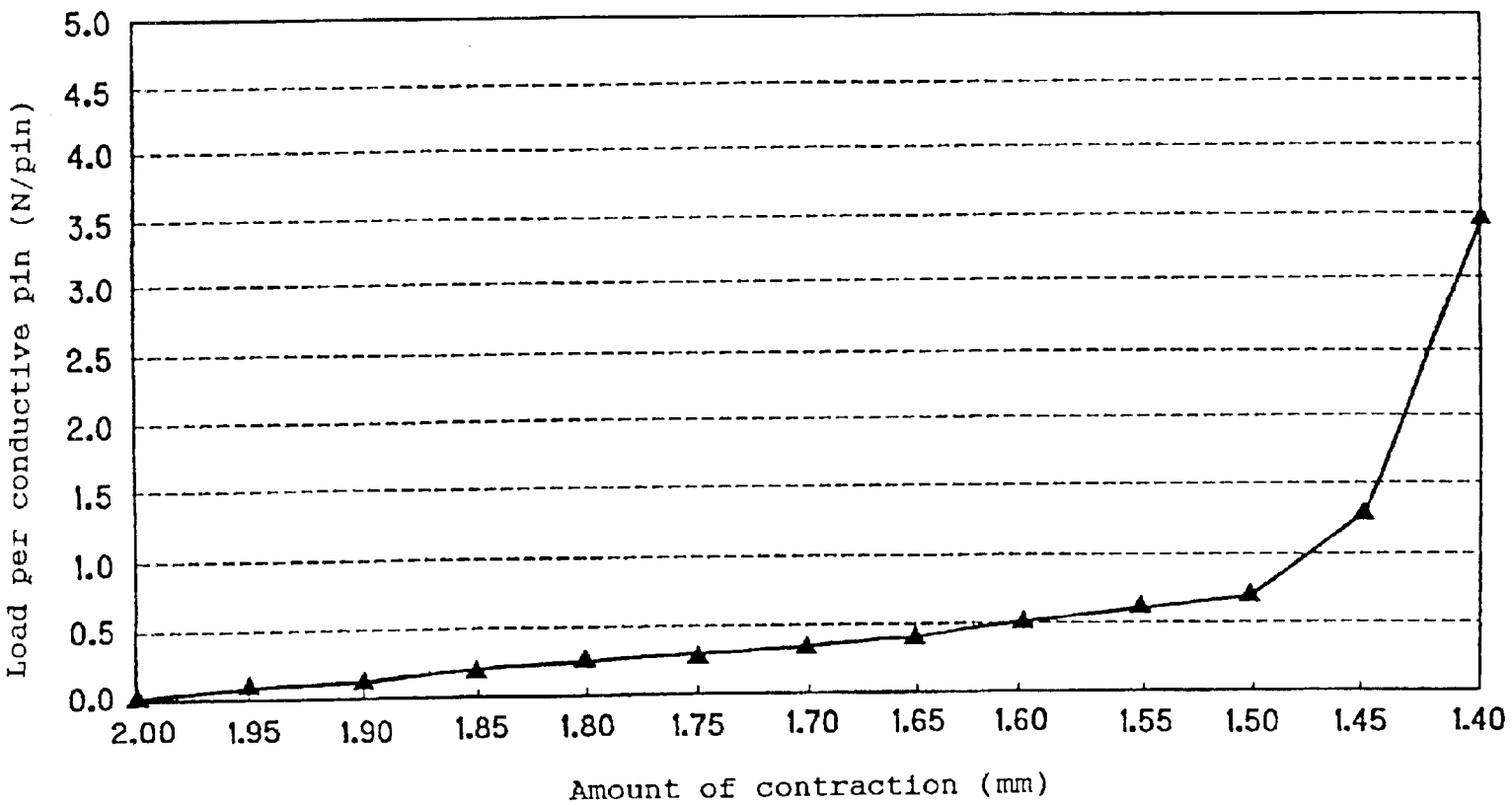
FIG. 4 is a graph showing the relationship between the amount of contraction and the load in the embodiment of compression type connectors and their connecting structure according to the present invention.

As seen from FIG. 4, according to the compression type connector of this embodiment, when ten conductive pins were compressed 0.4 mm, the load needed for each pin became as low as 0.5 N/pin. Thus, a low-load connection could be realized. As apparent from FIG. 5, when the conductive pins were compressed 0.4 mm, the connection resistance for each pin became as low as 13 m$\Omega$/pin. Thus, a low-resistant and stable conduction could be achieved.

Figure 7:
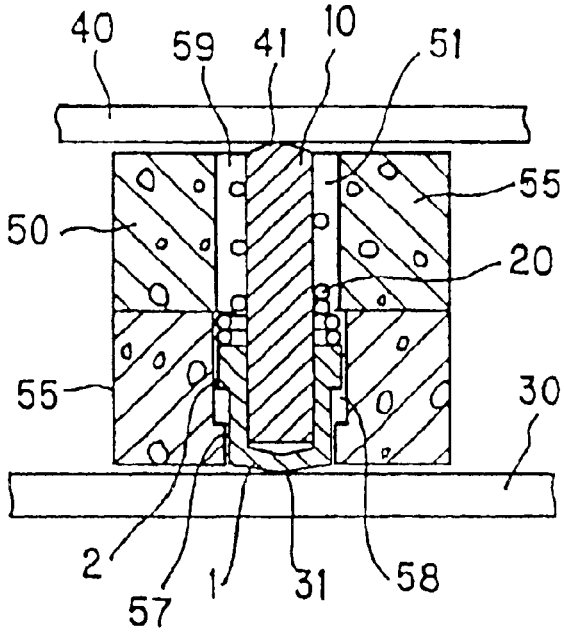
FIG. 7 is a sectional illustrative view showing a state where a compression type connector and its connecting structure according to the present invention are being used in the second embodiment.
Figure 8:
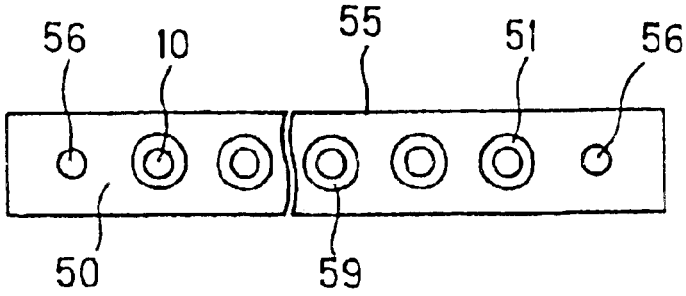
FIG. 8 is a plan view showing the second embodiment of compression type connectors and their connecting structure according to the present invention.
Figure 9:
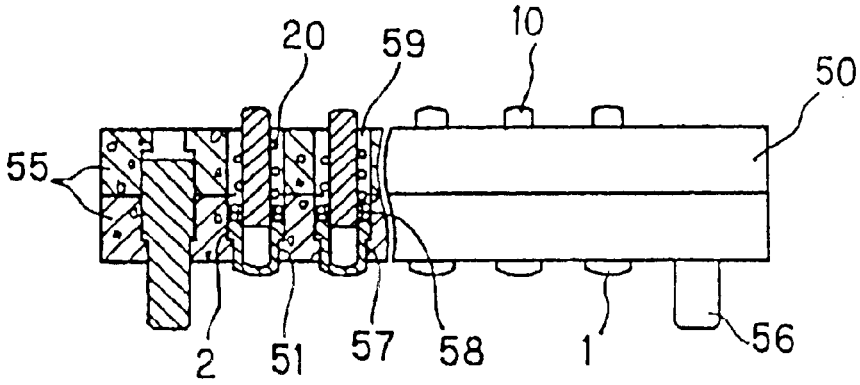
FIG. 9 is a partial sectional illustrative view showing the second embodiment of compression type connectors and their connecting structure according to the present invention.

Next, FIGS. 7 to 9 show the second embodiment. In this case, a conductive toe-pin 1 of the compression type connector is configured so as to project out and downwards in a sliding manner. That is, conductive toe-pin 1 and conductive pin 10 are caused to project out, in the opposite directions, upwards and downwards, by the repulsive force of coil spring 20. This compression type connector is disposed to each of multiple passage holes 51 of a housing 50 of a multiple-layered form.

As shown in FIGS. 7 and 9, conductive toe-pin 1 is formed of, for example, a cylinder with a bottom having an approximately U-shaped section, with gold-plated conductive material, specifically, copper, brass, aluminum or the like. Conductive toe-pin 1 is formed with a semispherical or conical bottom, and an annular flange 2 is formed radially outwardly on the outer periphery of the upper opening.

As seen in the same drawings, conductive pin 10 is, for example, formed of a cylindrical pin made of conductive elastomer or conductive copper, brass or aluminum plated with gold. This conductive pin 10 is shaped so that the top face is formed with a curved surface of a semispherical shape so that this top face will come into smooth contact with electrode 41 of electrically joined object 40. Conductive pin 10 is arranged so that it marginally projects above the top surface of housing 50 when it is connected for conduction. The projected amount is about 0.1 to 1.5 mm or preferably 0.5 to 1.0 mm.

As shown in FIGS. 7 and 9, housing 50 is formed of a pair of thin housing plates 55, laminated one over the other, forming a flat rectangular or plate-like structure with multiple small-diametric passage holes 51 bored and arranged lengthwise in a row with a pitch of about 0.5 mm to 1.27 mm. Each housing plate 55 is formed of multi-purpose engineering plastic which is excellent in heat resistance, dimensional stability, moldability and the like (for example, ABS resin, polycarbonate, polypropylene, polyethylene, etc.). Among these, ABS resin is the most suitable in view of workability and cost. Housing 50 has a pair of positioning pins 56 embedded at both extremes thereof so as to extend downwards and is positioned and fixed by each positioning pin 56 being fitted into an unillustrated positioning hole in electronic circuit board 30.

As shown in FIG. 7, each passage hole 51 is comprised of a first reduced-diameter bore 57 formed in the lower housing plate 55 and located on the electronic circuit board 30 side, a large-diametric and large-height bore 58 which is formed in the lower housing plate 55, continuously from the upper end of the first reduced-diameter bore 57 with a step therebetween, a second reduced-diameter and large-height bore 59 which is formed in the upper housing plate 55, located on the electrically joined object 40 side and ranging continuously from the upper end of large diametric bore 58 with a slight step therebetween, all being continuously formed. The step between the first reduced-diameter bore 57 and large-diametric bore 58 is adapted to receive flange 2 of conductive toe-pin 1. This engagement provides effective prevention of conductive toe-pin 1 descending and dislodging. Further, the bottom part of coil spring 20 fits in the boundary between large-diametric bore 58 and second reduced-diameter bore 59. This fitting provides effective prevention against displacement and dislodgment. The other components are the same as the preceding embodiment, so that the description is omitted.

In the above configuration, the compression type connector is positioned and fixed to electronic circuit board 30. Then the compression type connector is positioned and held between electronic circuit board 30 and electrically joined object 40 so that each electrode 31 of electronic circuit board 30 comes into contact with corresponding conductive toe-pin 1 while each electrode 41 of electrically joined object 40 comes into surface contact with conductive pin 10. In this state, electrically joined object 40 is lightly pressed against electronic circuit board 30, each coil spring 20 contracts and conductive toe-pin 1 and conductive pin 10 move upwards and downwards, closer to each other, whereby electrical conduction between electronic circuit board 30 and electrically joined object 40 can be elastically achieved by way of conductive toe-pin 1 and conductive pin 10.

Also in this embodiment, the same effect as the preceding embodiment can be expected. Besides, since conductive pin 10 and coil spring 20 are united and the conductive pin 10 is fitted inside conductive toe-pin 1 in a reciprocating manner, it is possible to reduce the height of the compression type connector when connected for conduction, without any difficulty and achieve an approximately one-third lower-resistance and low-load connection (e.g., 30 g to 60 g/pin). Further, since the lower end of coil spring 20 is appropriately held at the boundary between conductive toe-pin 1 and second reduced-diameter bore 59, it is possible to provide prevention of coil spring 20 falling off by a simple configuration. Moreover, since the compression type connectors are assembled by sandwiching the conductive parts with a pair of housing plates 55, this configuration with a simple structure markedly and effectively prevents conductive toe-pins 1, conductive pins 10 and coil springs 20 from displacing, dislodging or falling off.

Figure 10:
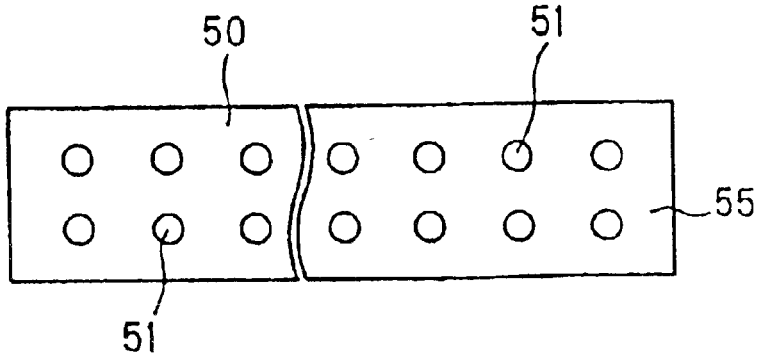
FIG. 10 is a plan view showing the third embodiment of compression type connectors and their connecting structure according to the present invention.

Next, FIG. 10 shows the third embodiment. In this case, multiple rows of small-diametric passage holes 51 arranged in the longitudinal direction of housing 50 with a predetermined pitch are formed and arrayed in a matrix, so as to mate matrix electrodes 41. The other components are the same as the second embodiment, so that the description is omitted.

Also in this embodiment, the same effect as the preceding embodiment can be expected. Besides, it is obvious that conduction between electronic circuit board 30 and electrically joined object 40 can be achieved in an effective manner in conformity with the number of electrodes 31 and 41 and configurations thereof.

Figure 11:
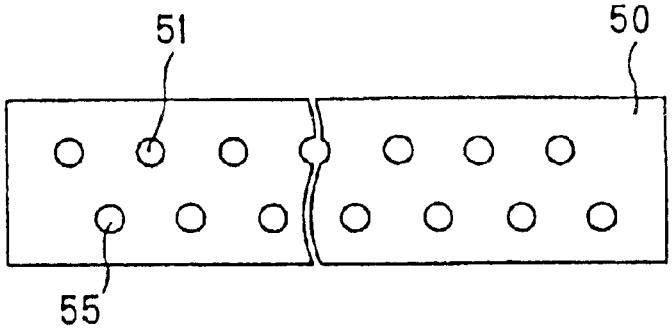
FIG. 11 is a plan view showing the fourth embodiment of compression type connectors and their connecting structure according to the present invention.

Next, FIG. 11 shows the fourth embodiment. In this case, multiple rows of small-diametric passage holes 51 arranged in the longitudinal direction of housing 50 with a predetermined pitch are formed with the multiple passage holes 51 arrayed in a staggered manner. The other components are the same as the second embodiment, so that the description is omitted.

Also in this embodiment, the same effect as the preceding embodiment can be expected. Besides, it is obvious that conduction between electronic circuit board 30 and electrically joined object 40 can be achieved in an effective manner in conformity with the number of electrodes 31 and 41 and configurations thereof.

Figure 12:
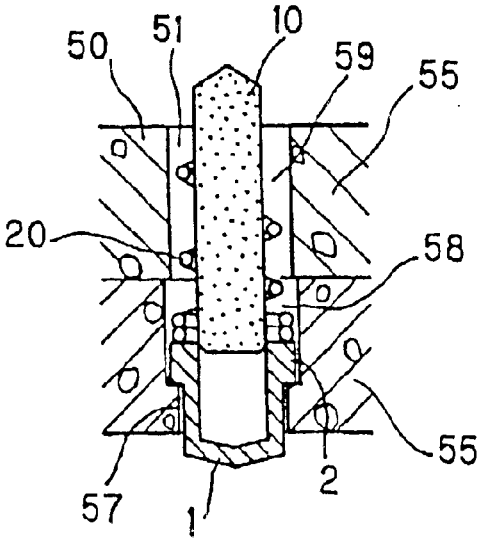
FIG. 12 is a sectional illustrative view showing the fifth embodiment of a compression type connector and its connecting structure according to the present invention.

Next, FIG. 12 shows the fifth embodiment. In this case, the head of each conductive pin 10 is shaped in a conical form so that the pointed head will come into point contact with electrode 41 of electrically joined object 40 to break the oxide film over the solder of electrode 41 so as to secure good conduction. The other components are the same as the second embodiment, so that the description is omitted.

Figure 13:
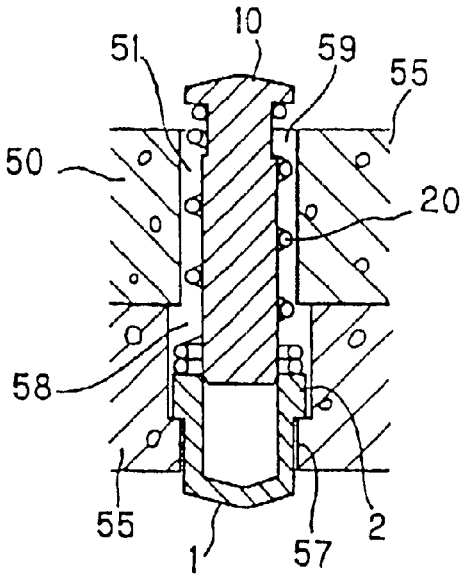
FIG. 13 is a sectional illustrative view showing the sixth embodiment of a compression type connector and its connecting structure according to the present invention.

Next, FIG. 13 shows the sixth embodiment. In this case, an upper part of each conductive pin 10 is reduced in diameter and conductive pin 10 is formed with a large-diametric obtuse conical head so that the pointed part will come into point contact with electrode 41 of electrically joined object 40 to break the oxide film over the solder of electrode 41. Further, the top end of coil spring 20 is fitted to the upper part of conductive pin 10 so as to effectively prevent the pin from falling off or displacing. The other components are the same as the second embodiment, so that the description is omitted.

Figure 14:
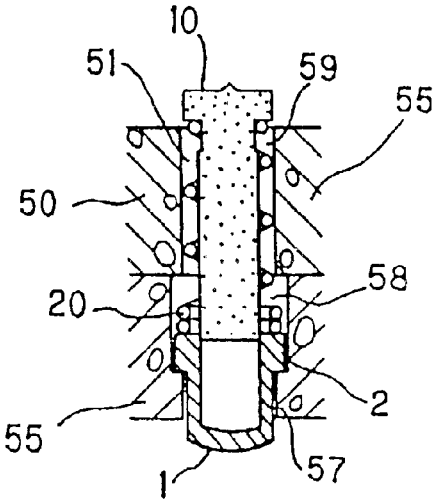
FIG. 14 is a sectional illustrative view showing the seventh embodiment of a compression type connector and its connecting structure according to the present invention.

Next, FIG. 14 shows the seventh embodiment. In this case, an upper part of each conductive pin 10 is reduced in diameter and conductive pin 10 is formed with a large-diametric head having a small pointed cone at the center of the flat top so that this cone will come into point contact with electrode 41 of electrically joined object 40 to break the oxide film over the solder of electrode 41. Further, the top end of coil spring 20 is fitted to the upper part of conductive pin 10 so as to effectively prevent the pin from falling off or displacing. The other components are the same as the second embodiment, so that the description is omitted.

Figure 15:
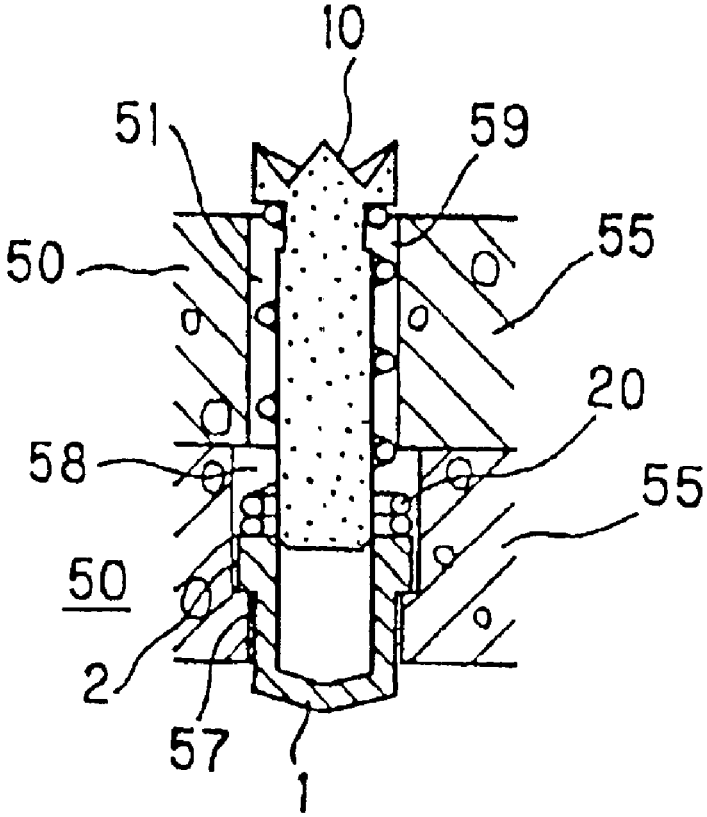
FIG. 15 is a sectional illustrative view showing the eighth embodiment of a compression type connector and its connecting structure according to the present invention.

Next, FIG. 15 shows the eighth embodiment. In this case, an upper part of each conductive pin 10 is reduced in diameter and conductive pin 10 is formed with a large-diametric crown-shaped or approximately dowel-shaped head so that the complexly jagged head will come into contact with electrode 41 of electrically joined object 40 and easily break the oxide film over the solder of electrode 41 (this configuration is especially effective in prevention against displacement for a BGA solder-ball electrode). Further, the top end of coil spring 20 is fitted to the upper part of conductive pin 10 so as to effectively prevent the pin from falling off or displacing. The other components are the same as the second embodiment, so that the description is omitted.

Figure 16:
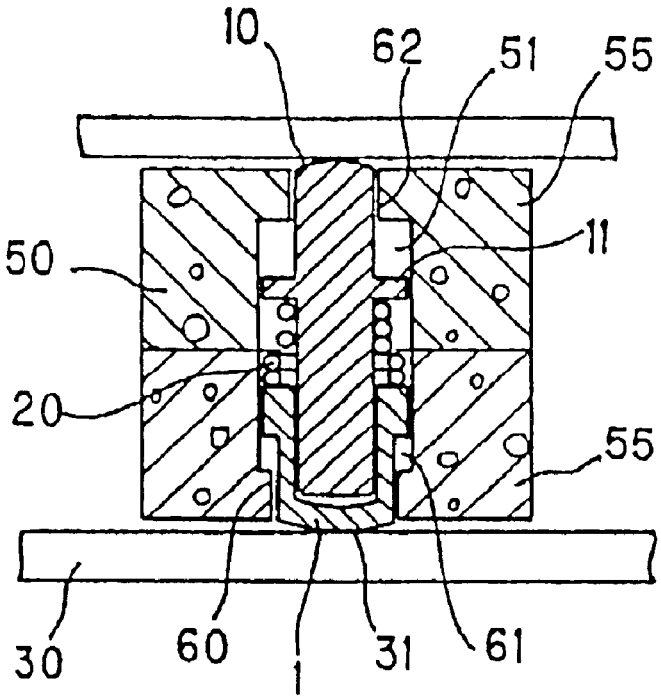
FIG. 16 is a sectional illustrative view showing the ninth embodiment of a compression type connector and its connecting structure according to the present invention.
Figure 17:
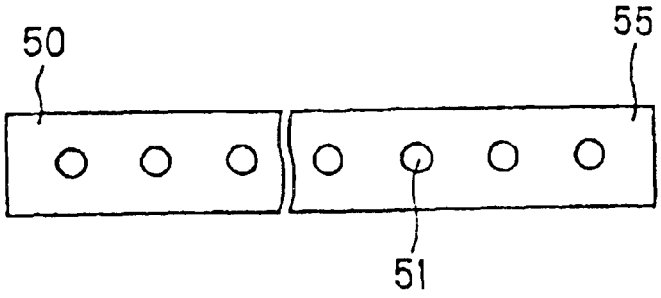
FIG. 17 is a plan view showing the ninth embodiment of compression type connectors and their connecting structure according to the present invention.
Figure 18:
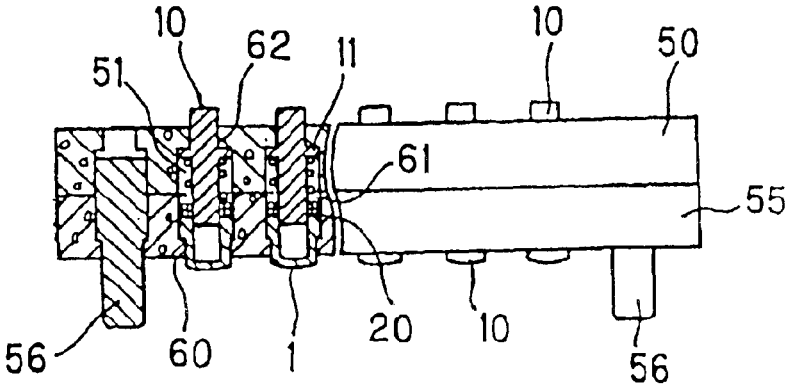
FIG. 18 is a partial sectional illustrative view showing the ninth embodiment of compression type connectors and their connecting structure according to the present invention.

Next, FIGS. 16 to 18 show the ninth embodiment. In this case, a conductive toe-pin 1 of the compression type connector is configured so as to project out and downwards in a sliding manner. That is, conductive toe-pin 1 and conductive pin 10 are caused to project out, in the opposite directions, upwards and downwards, by the repulsive force of coil spring 20. Further, an annular stopper flange 11 is formed radially outwardly from the upper part on the peripheral side of conductive pin 10, and this compression type connector is disposed to each of multiple passage holes 51 of a housing 50 of a multiple-layered form.

The conductive pin 10 is formed so that the top face is formed with a curved surface of a semispherical shape so that this top face marginally projects above the upper surface of housing 50 (by a projected amount of about 0.1 to 1.5 mm, or preferably 0.5 to 1.0 mm) so as to come into contact with electrode 41 of electrically joined object 40, making sure of conduction.

Coil spring 20 has a large-diametric portion at its bottom which abuts the upper end face of the opening of conductive toe-pin 1 while its upper part as a free end abuts the underside of stopper flange 11 of conductive pin 10.

Housing 50 is formed of a pair of thin housing plates 55, laminated one over the other, forming a flat rectangular or plate-like structure with small-diametric passage holes 51 bored and arranged lengthwise in a row with a predetermined pitch.

Each passage hole 51 is comprised of a reduced-diameter bore 60 formed in the lower housing plate 55 and located on the electronic circuit board 30 side, a large-diametric and large-height bore 61 which is formed in the housing plates 55, continuously from the upper end of the reduced-diameter bore 60 with a step therebetween, a small-diametric bore 62 which is formed in the upper housing plate 55, continuously from the upper end of the large-diametric bore 61 with a step therebetween and located on the electrically joined object 40 side, all being continuously formed. The step between the reduced-diameter bore 60 and large-diametric bore 61 is adapted to receive flange 2 of conductive toe-pin 1. This engagement provides markedly effective prevention of conductive toe-pin 1 descending and dislodging. The other step between the large-diametric bore 61 and small-diametric bore 62 is adapted to receive stopper flange 11 of conductive pin 10. This engagement provides effective prevention of conductive pin 10 falling off and other displacement. The other components are the same as the preceding embodiment, so that the description is omitted.

It is also obvious that, in this embodiment, the same effect as in the preceding embodiment can be expected.

Figure 19:
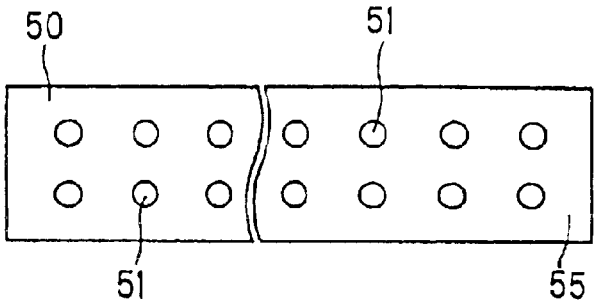
FIG. 19 is a plan view showing the tenth embodiment of compression type connectors and their connecting structure according to the present invention.

Next, FIG. 19 shows the tenth embodiment. In this case, multiple rows of small-diametric passage holes 51 arranged in the longitudinal direction of a housing 50 with a predetermined pitch are formed and arrayed in a matrix, so as to mate matrix electrodes 41. The other components are the same as the ninth embodiment, so that the description is omitted.

Figure 20:
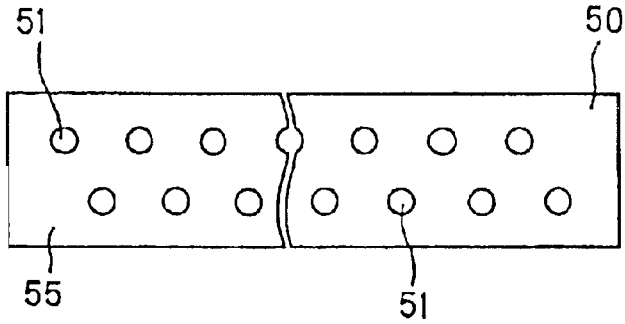
FIG. 20 is a plan view showing the eleventh embodiment of compression type connectors and their connecting structure according to the present invention.

Next, FIG. 20 shows the eleventh embodiment. In the case, multiple rows of small-diametric passage holes 51 arranged in the longitudinal direction of housing 50 with a predetermined pitch are formed with the multiple passage holes 51 arrayed in a staggered manner, so as to mate matrix electrodes 41. The other components are the same as the ninth embodiment, so that the description is omitted.

Figure 21:
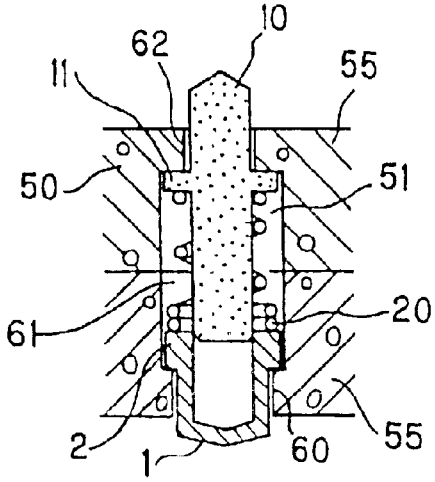
FIG. 21 is a sectional illustrative view showing the twelfth embodiment of a compression type connector and its connecting structure according to the present invention.

Next, FIG. 21 shows the twelfth embodiment. In the case, the head of each conductive pin 10 is shaped in a conical form so that the pointed head will come into point contact with electrode 41 of electrically joined object 40 to break the oxide film over the solder of electrode 41 so as to secure good conduction. The other components are the same as the ninth embodiment, so that the description is omitted.

Figure 22:
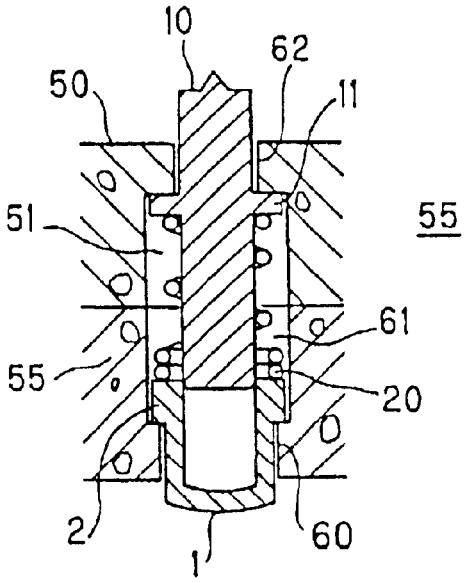
FIG. 22 is a sectional illustrative view showing the thirteenth embodiment of a compression type connector and its connecting structure according to the present invention.

Next, FIG. 22 shows the thirteenth embodiment. In this case, each conductive pin 10 is formed with a head having a small pointed cone at the center of the flat top so that this cone will come into point contact with electrode 41 of electrically joined object 40 to break the oxide film over the solder. The other components are the same as the ninth embodiment, so that the description is omitted.

Figure 23:
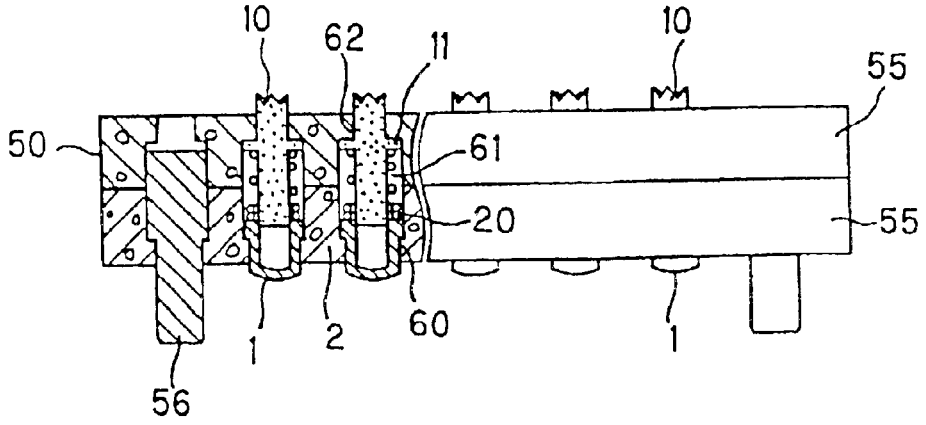
FIG. 23 is a partial sectional illustrative view showing the fourteenth embodiment of a compression type connector and its connecting structure according to the present invention.

Next, FIG. 23 shows the fourteenth embodiment. In this case, each conductive pin 10 is projectively formed with a large-diametric crown-shaped or approximately dowel-shaped head so that the jagged head will come into contact with electrode 41 of electrically joined object 40 and easily break the oxide film over the solder of electrode 41 (this configuration is especially effective in prevention against displacement for a BGA solder-ball electrode). The other components are the same as the ninth embodiment, so that the description is omitted.

Next, FIGS. 24 through 27 show the fifteenth embodiment. This embodiment includes an insulative holder 73 of a cylinder with a bottom for accommodating an electroacoustic part, interposed between an electronic circuit board 30 of a cellular phone and a miniature electroacoustic part 70, one opposing the other. A multiple number of passage holes 51 are formed in an insulative housing 50, which is attached to the bottom part of holder 73, and a multiple number of dummy probes 80 are also formed in the holder bottom. A compression type connector is set in each passage hole 51. This compression type connector is arranged so that the bottom part of the conductive toe-pin is exposed downward from the undersurface side of the holder's bottom while conductive pin 10 of the compression type connector is projected from the obverse side of the holder's bottom toward the electroacoustic part.

Figure 24:
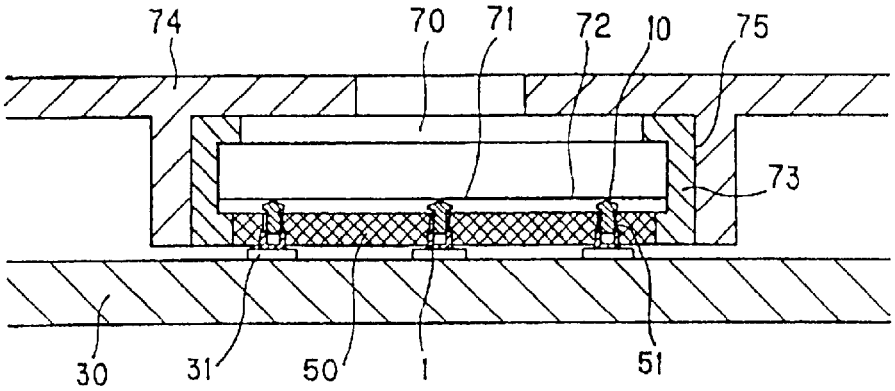
FIG. 24 is a sectional illustrative view showing a state where compression type connectors and their connecting structure according to the present invention are being used in the fifteenth embodiment.
Figure 26:
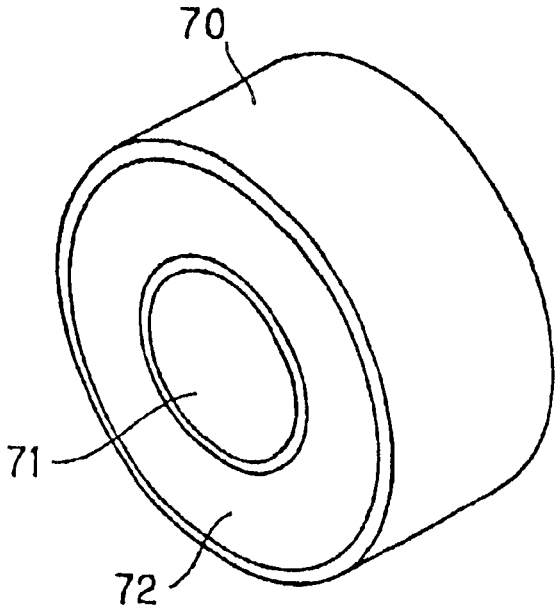
FIG. 26 is a perspective view showing an electroacoustic part in the fifteenth embodiment of compression type connectors and their connecting structure according to the present invention.

Since electronic circuit board 30 has the same configuration as described above, the description is omitted. Electroacoustic part 70, as shown in FIGS. 24 and 26, may be a miniature microphone for a cellular phone, etc., for example, and has a circular electrode 71 at the center of the bottom and a doughnut electrode 72 enclosing the circular electrode 71, on the remaining peripheral part of the bottom. The circular electrode 71 and doughnut electrode 72 oppose the bottom of holder 73 with a clearance therebetween.

Figure 25:
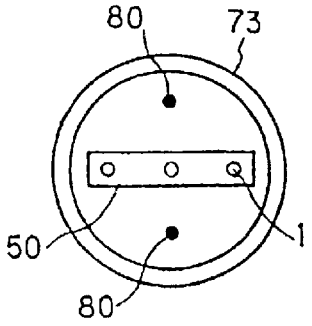
FIG. 25 is a bottom view showing the fifteenth embodiment of compression type connectors and their connecting structure according to the present invention.

As shown in FIGS. 24 and 25, holder 73 has an approximately U-shaped section, and is formed of a predetermined insulative elastomer and fitted to an attachment port 75 of a body case 74 of a cellular phone or the like to provide an anti-vibration function as well as an anti-howling function. Examples of the specific materials for this holder 73 having elastic properties include natural rubber, polyisoprene, polybutadiene, chloroprene rubber, polyurethane rubber and silicone rubber. Among these, silicone rubber is the most suitable taking into account weatherability, distortion under compression characteristics, workability and other factors.

The bottom part of holder 73, may either be, or need not, be, formed of the aforementioned insulative elastomer. For example, the bottom part of holder 73 can be formed separately, of a predetermined plastic. In this case, examples of the specific materials include ABS resin, polycarbonate, polypropylene and polyethylene. Among these, ABS resin is the most suitable taking into account retention of compression type connectors, workability, cost and other factors. A flange 76 is projected radially inwardly from the inner rim of the top opening of holder 73 so as to effectively prevent electroacoustic part 70 from dislodging.

Figure 27:
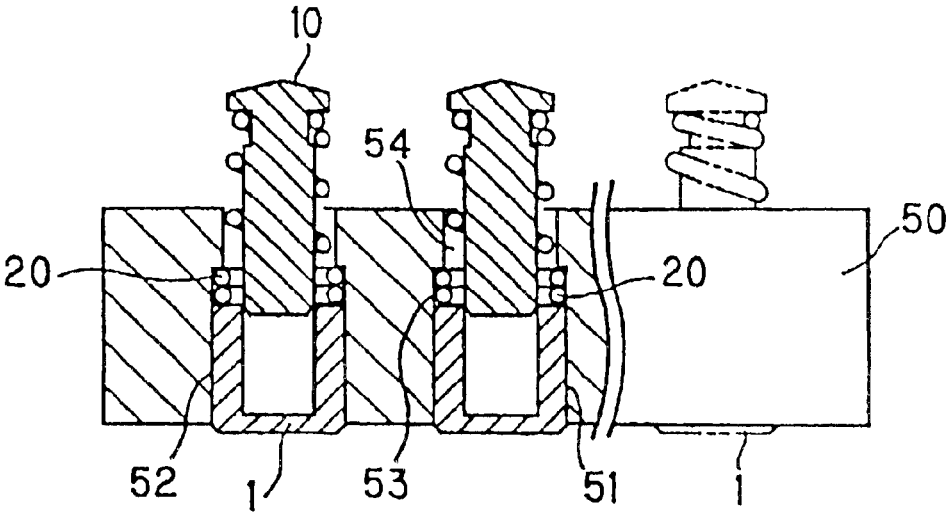
FIG. 27 is a sectional illustrative view showing the fifteenth embodiment of compression type connectors and their connecting structure according to the present invention.

As shown in FIG. 27, the housing 50 and compression type connector are much the same as those in the first and second embodiments, so that the description is omitted.

As shown in FIG. 25, the multiple dummy probes 80 are formed in a pin form using the same material as holder 73, and have much the same height and size as the compression type connector and function to appropriately support electroacoustic part 70 in cooperation with the compression type connectors. Each dummy probe 80 is integrated with the bottom part of holder 73 and put in contact with doughnut electrode 72 of electroacoustic part 70. The other components are the same as the preceding embodiment.

In the above arrangement, fitting electroacoustic part 70 into holder 73 from the opening side so that the top ends of the compression type connectors and dummy probes 80 are put into contact with circular electrode 71 and doughnut electrode 72, fitting holder 73 to attachment port 75 of body case 74, and connecting the bottom ends of multiple conductive toe-pins 1 to electrodes 31 of electronic circuit board 30 by direct pressing or by fixed connection by means of ACF, etc., enables electroacoustic part 70 to be assembled into body case 74 of a cellular phone or the like, easily and appropriately, whereby it is possible to secure conduction between electronic circuit board 30 and electroacoustic part 70 (see FIG. 24).

Also in this embodiment, the same effect as in the preceding embodiment can be expected. Further, since wire soldering can be omitted, it is not only possible to obviate the necessity of complicated work management, but also a low-load connection can be highly expected. Further, since electroacoustic part 70 can be held in its correct posture by means of miniature compression type connectors and dummy probes 80, electroacoustic part 70 can be prevented from being tilted or displaced, by a simple configuration. Moreover, since compression type connectors are arranged between electronic circuit board 30 and electroacoustic part 70, by means of holder 73 and housing 50, the compression type connectors can be assembled or mounted by a simple arrangement, hence it is possible to markedly improve positioning accuracy and assembly performance.

Figure 28:
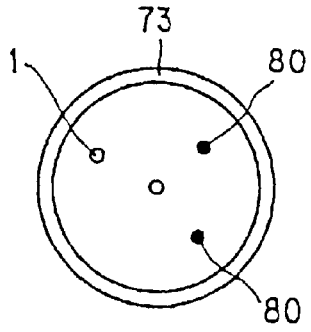
FIG. 28 is a bottom view showing the sixteenth embodiment of compression type connectors and their connecting structure according to the present invention.

Next, FIG. 28 shows the sixteenth embodiment. In this case, compression type connectors are directly arranged in the bottom of holder 73, instead of using a housing 50, in order to reduce the number of parts, and the compression type connectors and dummy probes 80 are changed in their number and layout, as shown in the drawing. The other components are the same as the fifteenth embodiment, so that the description is omitted.

Figure 29:
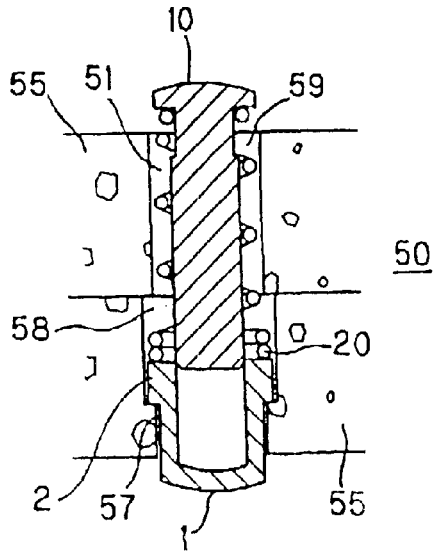
FIG. 29 is a sectional illustrative view showing the seventeenth embodiment of a compression type connector and its connecting structure according to the present invention.

Next, FIG. 29 shows the seventeenth embodiment. In this case, the housing 50 is formed in a multiple-layered structure, and each passage hole 51 is formed as in the second embodiment so that a conductive toe-pin 1 is fitted in a slidable manner into the passage hole 51 while the head of each conductive pin 10 is curved or formed in a semi-spherical form and the bottom part of each coil spring 20 is made large in diameter and loosely fitted at the boundary between a large-diametric bore 58 and second reduced-diameter bore 59 of passage hole 51.

The bottom face of each conductive toe-pin 1 is curved or formed in a smooth semispherical shape. A large-diametric flange 2 is formed in the upper part of conductive toe-pin 1 on its outer periphery. This flange 2 abuts the step between a first reduced-diameter bore 57 and large-diametric bore 58 so that it will not come off. This conductive toe-pin 1 is not fixed but is projected out, by the repulsive force of coil spring 20, from housing 50 of holder 73 downwards in a vertically movable manner. The other components are the same as in the fifteenth embodiment, so that the description is omitted.

Figure 30:
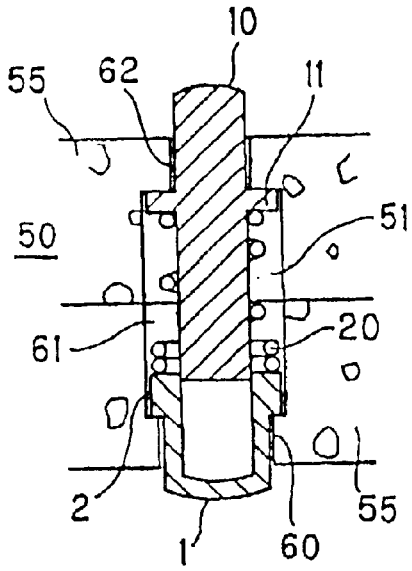
FIG. 30 is a sectional illustrative view showing the eighteenth embodiment of a compression type connector and its connecting structure according to the present invention.

Next, FIG. 30 shows the eighteenth embodiment. In this case, each passage hole 51 is formed as in the ninth embodiment. Each conductive pin 10 has an annular stopper flange 11 projected radially outwardly from the peripheral side at the upper part thereof while the head of the conductive pin 10 is not made large in diameter and is formed with a smooth semispherical surface. A coil spring 20 is formed in a cylindrical shape with its lower end and middle part loosely fitted in a large-diametric bore 61 of passage hole 51. The coil spring 20 is set so that its upper end abuts the stopper flange 11 of conducive pin 10 and the other end rests on the top outer peripheral surface of conductive toe-pin 1.

Stopper flange 11 of conductive pin 10 abuts the step between a reduced-diameter bore 60 and large-diametric bore 61 of passage hole 51 so that it will not dislodge or come off. The other components are the same as in the seventeenth embodiment, so that the description is omitted.

Figure 31:
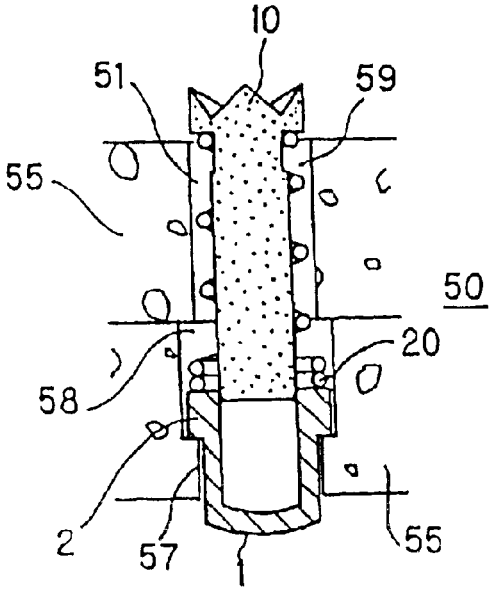
FIG. 31 is a sectional illustrative view showing the nineteenth embodiment of a compression type connector and its connecting structure according to the present invention.

Next, FIG. 31 shows the nineteenth embodiment. In this case, the housing 50 is formed in a multiple-layered structure, and each passage hole 51 is formed as in the second embodiment so that a conductive toe-pin 1 is fitted in a slidable manner into the passage hole 51. Further, the head of each conductive pin 10 is formed with a large-diametric complexly jagged or approximately tooth-shaped pin-joint dowel form, so that it will easily break the oxide film of solder plating, for example, of circular electrode 71 or doughnut electrode 72 of electroacoustic part 70. The bottom end of each coil spring 20 is formed to be large in diameter so that it is loosely fitted inside a large-diametric bore 58 of passage hole 51. The other components are the same as in the seventeenth embodiment, so that the description is omitted.

In the above embodiment, housing 50 with passage holes 51 is united to the bottom part of holder 73, but the invention should not be limited thereto. For example, the bottom part of holder 73 may be formed by fitting a housing 50 molded of a plastic resin, for example, as shown in FIG. 28, and multiple passage holes 51 may be directly formed in this bottom part. Housing 50 may be rectangular, or square, circular, elliptic or oval or of other shapes. Further, the fifteenth, sixteenth, seventeenth, eighteenth and nineteenth embodiments may be modified or combined appropriately.

INDUSTRIAL APPLICABILITY

As has been described heretofore, according to the invention of claim 1, it is possible to provide the effect of reducing the height of connection so as to shorten the route of conduction and achieving a low-load connection between electrodes.

Further, according to the invention of claim 2, it is possible to improve the positioning accuracy and assembly performance.

Moreover, according to the invention of claim 3, soldering upon connection can be omitted so that it is possible to simplify the connecting work.

What is claimed is:

1. A compression type connector in a circumferential groove of the conductive pin comprising: a conductive toe-pin having a cap-like shape; a conductive pin fitted into the conductive toe-pin in a slidable manner; and a spring fitted on conductive pin, characterized in that the spring rests on the opening end face of the conductive toe-pin so as to urge the conductive pin in the direction opposite the bottom of the conductive-toe pin, wherein the spring is fixedly attached to one end of the connector but is free of attachment at the other end.

2. A connecting structure of compression type connectors, characterized in that an insulative housing to be interposed between opposing electrodes has a multiple number of passage holes formed therein, and a compression type connector defined in claim 1 is fitted in each passage hole in such a manner that the bottom of the conductive toe-pin of the compression type connector is projected from one side of the housing and the conductive pin of the compression type connector is projected on the other side of the housing, wherein each passage hole in the insulative housing is constructed such that at least one part of the compression type connector is fixed in position relative to the insulative housing.

3. A connecting structure of compression type connectors, characterized in that an insulative holder to be interposed between opposing electrodes is formed in an approximate cylinder with a bottom and has a multiple number of passage holes formed in the bottom, and a compression type connector defined in claim 1 is fitted in each passage hole in such a manner that the bottom of the conductive toe-pin of the compression type connector is projected from one side of the holder's bottom and the conductive pin of the compression type connector is projected on the other side of the holder's bottom, toward the open side, wherein each passage hole in the insulative housing is constructed such that at least one part of the compression type connector is fixed in position relative to the insulative housing.

* * * * *